US007905709B2

(12) United States Patent
Lagrange et al.

(10) Patent No.: US 7,905,709 B2
(45) Date of Patent: Mar. 15, 2011

(54) ADVANCED FIRTREE AND BROACH SLOT FORMS FOR TURBINE STAGE 1 AND 2 BUCKETS AND ROTOR WHEELS

(75) Inventors: Benjamin Arnette Lagrange, Simpsonville, SC (US); Timothy Brian Lloyd, Greenville, SC (US)

(73) Assignee: General Electric Company, Schenectady, NY (US)

( * ) Notice: Subject to any disclaimer, the term of this patent is extended or adjusted under 35 U.S.C. 154(b) by 5 days.

(21) Appl. No.: 10/774,400

(22) Filed: Feb. 10, 2004

(65) Prior Publication Data

US 2005/0175462 A1 Aug. 11, 2005

(51) Int. Cl.
*F01D 5/30* (2006.01)

(52) U.S. Cl. ..... 416/219 R

(58) Field of Classification Search ..... 416/219 R, 416/220 R, 221, 239, 248
See application file for complete search history.

(56) References Cited

U.S. PATENT DOCUMENTS

| | | | | |
|---|---|---|---|---|
| 2,755,062 | A * | 7/1956 | Hill | 416/221 |
| 2,949,278 | A | 8/1960 | McCormick | |
| 3,202,398 | A * | 8/1965 | Webb | 416/220 R |
| 3,575,522 | A * | 4/1971 | Melenchuk | 416/220 R |
| 4,191,509 | A * | 3/1980 | Leonardi | 416/219 R |
| 4,260,331 | A | 4/1981 | Goodwin | |
| 4,824,328 | A | 4/1989 | Pisz et al. | |
| 5,147,180 | A * | 9/1992 | Johnson | 416/219 R |
| 5,176,500 | A * | 1/1993 | Heinig | 416/219 R |
| 5,688,108 | A | 11/1997 | Dierksmeier et al. | |
| 5,741,119 | A | 4/1998 | Heppenstall | |
| 5,836,742 | A | 11/1998 | Dierksmeier et al. | |
| 5,863,183 | A | 1/1999 | Dierksmeier et al. | |
| 6,030,178 | A * | 2/2000 | Caruso | 416/220 R |
| 6,099,245 | A | 8/2000 | Bunker | |
| 6,450,770 | B1 | 9/2002 | Wang et al. | |
| 6,461,110 | B1 | 10/2002 | By et al. | |
| 6,893,226 | B2 * | 5/2005 | Phipps | 416/248 |

FOREIGN PATENT DOCUMENTS

| | | | | |
|---|---|---|---|---|
| EP | 1 296 022 | | 3/2003 | |
| GB | 677142 | A * | 8/1952 | 416/219 R |
| JP | 63-306208 | A | 12/1988 | |
| JP | 06-010606 | A | 1/1994 | |
| JP | 06-248902 | A | 9/1994 | |
| JP | 2002-544432 | A | 12/2002 | |
| JP | 2003-176703 | A | 6/2003 | |

OTHER PUBLICATIONS

European Search Report, Appln. GB0502652.1 (Jun. 28, 2005).

* cited by examiner

*Primary Examiner* — Christopher Verdier
(74) *Attorney, Agent, or Firm* — Nixon & Vanderhye P.C.

(57) ABSTRACT

A turbine bucket and wheelpost assembly reduces the number of buckets in at least one of the stages of the turbine from 92 to 60 while reducing stresses at the assembly points of the buckets and wheelposts. The buckets and wheelposts being formed with complementary fillets and tangs that provide for the insertion of the bucket into the broach slot between two wheelposts. The angles of the tang surfaces on both the bucket and wheelpost range from 50° to 57°. The upper surface of the wheelpost is scalloped to reduce weight and the tangs and fillets of both the bucket and wheelpost are formed from curved and straight surfaces to reduce stresses on the assembly.

9 Claims, 13 Drawing Sheets

ADVANCED FIRTREE AND BROACH SLOT FORMS FOR TURBINE STAGE 1 AND 2 BUCKETS AND ROTOR WHEELS

FIELD OF THE INVENTION

The invention is directed to turbines and, more particularly, to an improved configuration for the root portion, known as a firtree, of a turbine bucket and the corresponding turbine wheel broach slot into which the bucket fits. More specifically, the present invention provides improved firtree/broach slot configurations that reduce the number of buckets required and the stresses acting on the buckets and wheel at the point of their attachment.

BACKGROUND OF THE INVENTION

The stages of a typical gas turbine can have as many as 92 buckets that radially extend from a rotor or wheel. Each bucket has a root portion that is configured to mate with a corresponding broach slot in the wheel. The firtree/broach slot configurations are designed to reduce stresses that occur transiently and at normal operating speeds.

Prior known firtree/broach slot configurations are disclosed in Goodwin, U.S. Pat. No. 4,260,331 issued on Apr. 7, 1981, Pisz et al., U.S. Pat. No. 4,824,328 issued on Apr. 25, 1989, Dierksmeier et al., U.S. Pat. No. 5,688,108 issued on Nov. 18, 1997, Heppenstall, U.S. Pat. No. 5,741,119 issued on Apr. 21, 1998, Dierksmeier et al., U.S. Pat. No. 5,836,742 issued on Nov. 17, 1998, and Dierksmeier et al., U.S. Pat. No. 5,863,183 issued on Jan. 26, 1999. Each one of these prior art patents describes the particular details of the geometric assimilation of lines, arcs, and angles of its disclosed firtree/broach slot configuration for the purposes of reducing centrifugal forces, bending moments, and vibrations and the consequential peak stresses that result at the attachment points.

It is desirable to reduce the number of buckets to be attached to the wheel for a number of reasons, including fewer parts (less cost), less required cooling air, higher natural frequencies, less profile losses (skin friction), and reduced overtip leakage. However, a reduction in the number of buckets also results in each individual bucket being heavier as it covers a longer circumferential length. Simply scaling the size of the buckets and slots on existing firtree and broach slot configurations, while maintaining the same size wheel, to reduce the number of buckets will not minimize the stresses acting at the attachment points.

SUMMARY OF THE INVENTION

It is an object of the present invention to provide an improved firtree/broach slot configuration or form that enhances the transfer of load from the bucket (buckets, also known as blades, include the airfoil, shank, and firtree attachment) to the wheel (also known as disk) for a high temperature turbine stage having only 60 buckets.

Another object of the present invention reduces the magnitude of the pull force on the rotor wheel by the bucket firtree and wheelpost known as the dead rim annulus.

Further objects of the present invention are to reduce the magnitudes of the concentrated stresses in the form for improved low cycle fatigue (LCF) and high cycle fatigue (HCF) capability of both the bucket and the wheel, and improve the necessary capacity for delivering cooling air to the buckets (air passage area).

Still further objects of the present invention are to reduce the capacity for leaks across the stage through the firtree, and equalize the load transfer from the bucket to the wheelpost among the tangs.

The present invention is designed with the intent and goal of improved fuel efficiency over previous designs. Several measures have been taken in the hot gas path to contribute to this goal, among them being a reduced bucket count. Stages 1 and 2 in the turbine have 60 buckets rather than the typical 92 bucket count. The benefits of reduced bucket count include: fewer parts (cost), less required cooling air, higher natural frequencies, less profile losses (skin friction), reduced overtip leakage, etc.

However, a reduced count also results in each individual bucket being heavier as it covers a longer circumferential length. This increased weight and circumferential length have been accounted for in the new firtree form since the prior art forms were typically designed for as many as 92 buckets.

The new firtree form has unique dimensions and relationships between the bucket and wheel necessary for enhancing transfer of the bucket load into the wheelpost, while reducing concentrated stresses and rotor pull. The new firtree form was arrived at by iteration of form parameters and thermo-mechanical loading. This form has certain key features that have improved this load transfer successfully.

This form may be scaled to larger or smaller sizes provided, however, that the rotor wheel or disk diameters are correspondingly scaled to larger or smaller sizes or that the two sides of the bucket and wheel are offset similarly, i.e., wider or narrower. In addition, although a preferred range of tolerances for the dimensions of the bucket and wheel are provided herein, those skilled in the art will recognize that a broader range of tolerances could also be employed in practicing the invention.

Although the intended use for this form is the GE 6C IGT model gas turbine, it, or any scale of it, may be applied to other applications where blades or buckets are attached to a rotating wheel or disk in a high temperature environment.

DETAILED DESCRIPTION OF THE INVENTION

Key and fundamental elements of the invention are defined by two series of lines, arcs, and ellipses of which the adjacent components are tangent. One series depicts the profile or form of the firtree shape of the bucket root while the other series depicts the profile or form of the corresponding broach slot of the rotor wheel into which the firtree shape is fitted.

Figure 1:
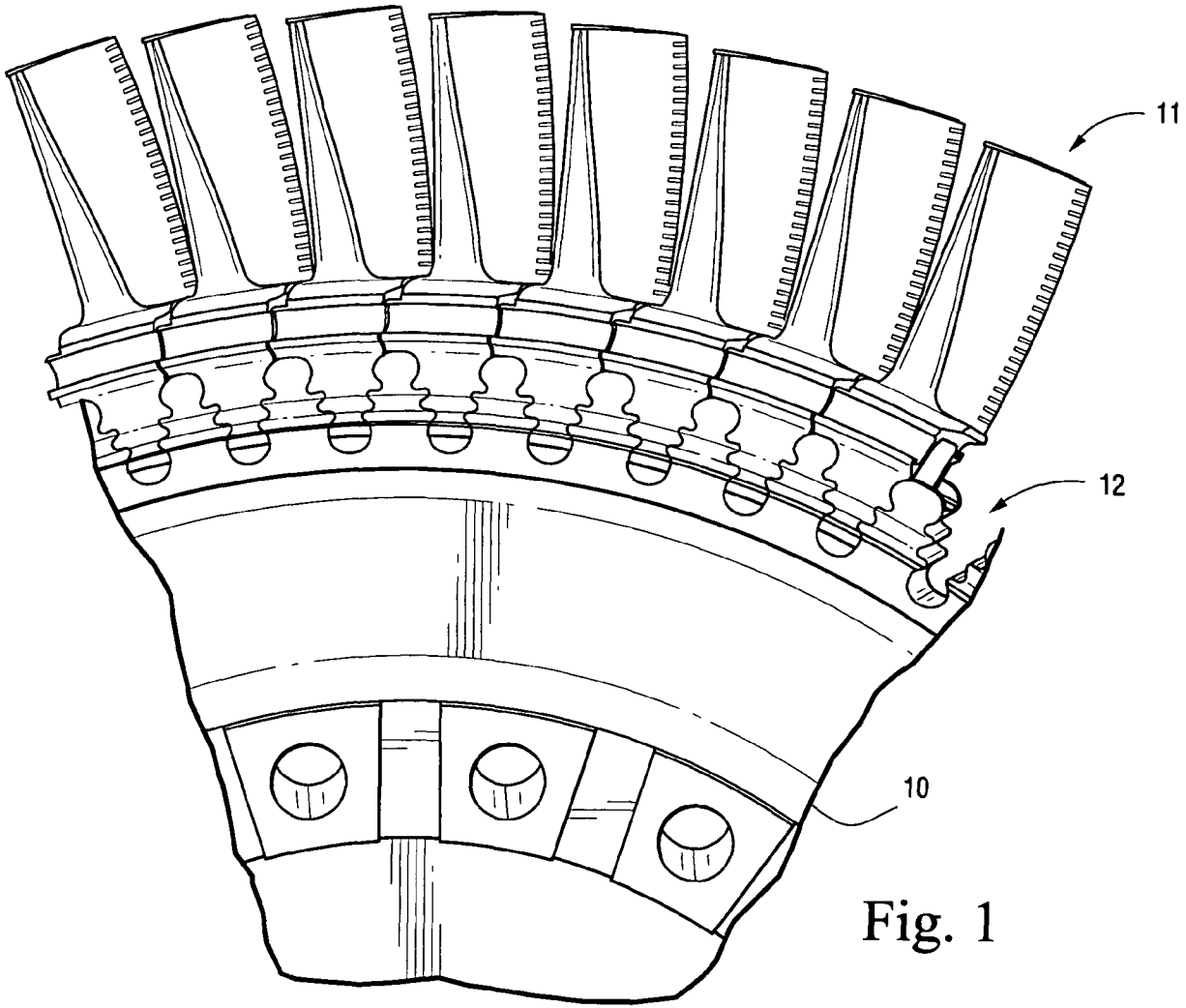
FIG. 1 shows a portion of a turbine wheel with attached buckets.

FIG. 1 shows a portion of an assembled rotor wheel 10 to include buckets 11 fitted into corresponding broach slots 12. Thus, the profile of the wheel broach slot 12 (best seen in the unfilled broach slot in FIG. 1) is substantially filled by the portion of the bucket 11 termed the bucket root (best seen by the filled wheel broach slots in FIG. 1).

Figure 2A:
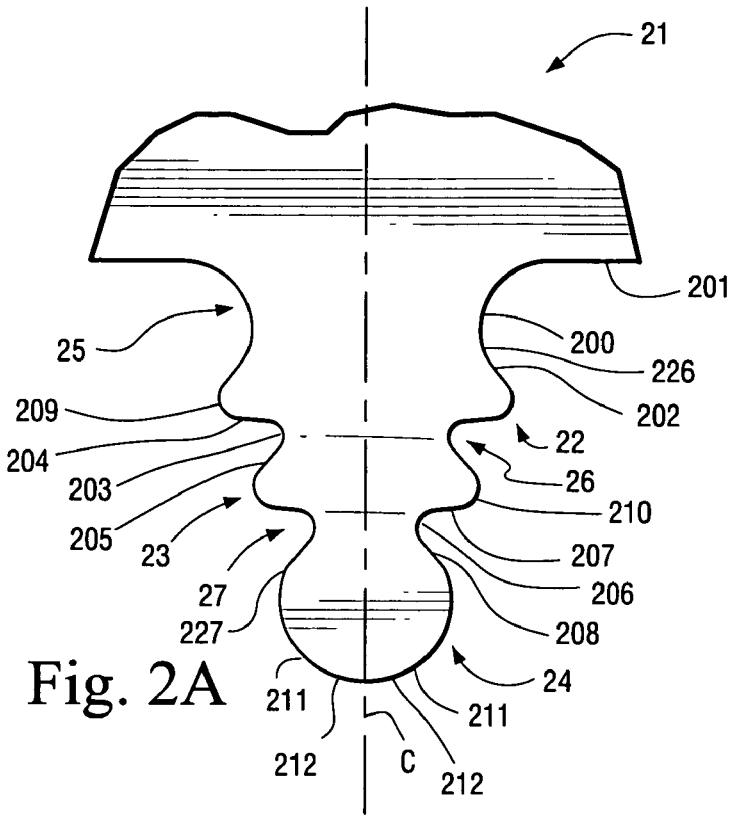
FIG. 2A represents a cross-sectional schematic drawing of a portion of a bucket at the attachment and depicts the firtree profile.

FIG. 2A shows in cross-sectional schematic form the profile of bucket root 21 of bucket 11. Bucket root 21 comprises three sets of curved tangs 22, 23, 24 and three sets of fillets 25, 26, 27. One tang and fillet, from each set of tangs and fillets, is disposed on either side of centerline C. On either side of center line C and above tangs 22 are disposed fillets 25. Tangs 22 are disposed on either side of centerline C between fillets 25 and 26. Tangs 23 are disposed on either side of centerline C between fillets 26 and 27. Tangs 24 are joined to each other at centerline C and are disposed below fillets 27.

Each one of fillets 25, 26, 27 comprises an inwardly curved radial surface at its center together with two substantially straight surfaces on either side of the curved radial surface. In the case of fillet 25, the central curved surface is joined to the lower straight surface by way of a transitioning arc. For each fillet 25, curved surface 200 is connected to straight surface 201 at its upper end that also forms an upper portion of bucket root 21, and transitioning arc 226 at its lower end. The other end of arc 226 connects to straight surface 202 that also forms a part of tang 22. For each fillet 26, curved surface 203 is sandwiched by upper straight surface 204 that also forms a part of tang 22 and lower straight surface 205 that also forms a part of tang 23. For each fillet 27, curved surface 206 is sandwiched by upper straight surface 207 that also forms a part of tang 23 and lower straight surface 208 that also forms a part of tang 24.

Each one of tangs 22, 23 comprises an outwardly curved radial surface sandwiched by straight surfaces on either side. For each tang 22, curved surface 209 is sandwiched by upper straight surface 202 that also forms a part of fillet 25, and lower straight surface 204 that also forms a part of fillet 26. For each tang 23, curved surface 210 is sandwiched by upper straight surface 205 that also forms a part of fillet 26 and lower straight surface 207 that also forms a part of fillet 27.

Each one of tangs 24 comprises an outwardly curved surface sandwiched by curved and straight surfaces on either side. For each tang 24, outwardly curved surface 211 connects at its upper end to elliptical surface 227 that transitions into straight surface 208 that also forms a part of fillet 27. At its lower end, surface 211 connects to another outwardly curved surface 212 with the curved surfaces 212 of each tang 24 being joined at the centerline C.

Figure 2B:
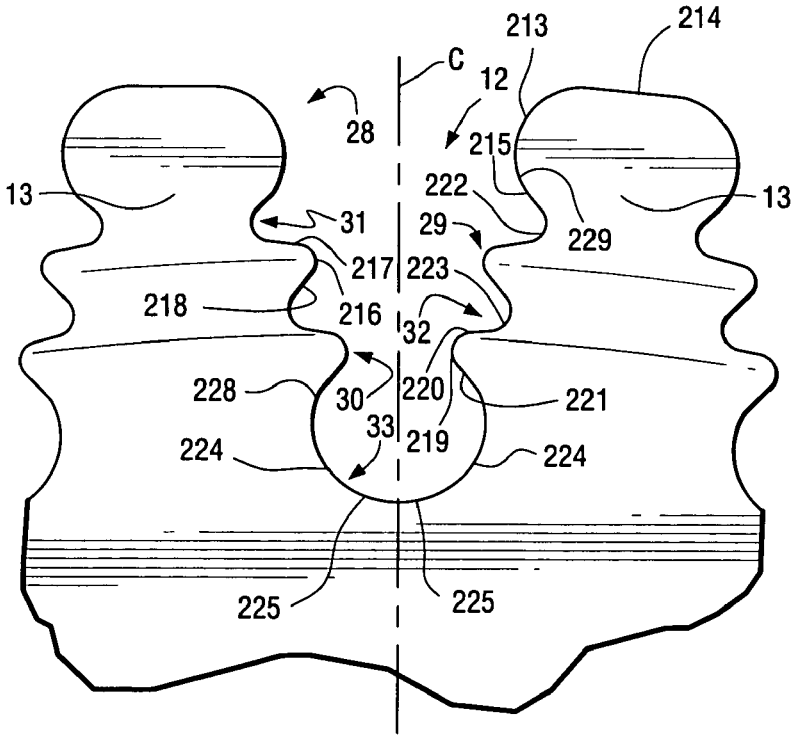
FIG. 2B represents a cross-sectional schematic drawing of a portion of a turbine wheel at the attachment and depicts the broach slot profile.

FIG. 2B shows in cross-sectional schematic form the profile of broach slot 12 of rotor wheel 10. Broach slot 12 comprises the physical space between two adjacent wheelposts 13 and is thus defined by the same set of curves. Broach slot 12 comprises three sets of tangs 28, 29, 30 and three sets of fillets 31, 32, and 33. The fillets and tangs of broach slot 12 are complimentary to the tangs and fillets of bucket root 21 so that bucket root 21 can be fitted within broach slot 12.

Each one of tangs 29, 30 comprises an outwardly curved radial surface sandwiched between straight surfaces. For each tang 29, curved surface 216 is sandwiched by upper straight surface 217 that also forms a part of internal fillet 31, and lower straight surface 218 that also forms a part of fillet 32. For each tang 30, curved surface 219 is sandwiched by the upper straight surface 220 that also forms a part of fillet 32 and lower straight surface 221 that also forms a part of fillet 33.

Each one of tangs 28 comprises an outwardly curved surface connected to a straight surface at its upper end and transitioning to a straight surface at its lower end by way of an elliptical curve. For each tang 28, curved surface 213 connects at its upper end to straight surface 214 that forms a top surface adjacent to another broach slot 12. At its lower end, surface 213 connects to elliptical surface 229 that transitions into straight surface 215 that also forms part of fillet 31.

Each one of fillets 31, 32 comprises an inwardly curved radial surface sandwiched by substantially straight surfaces on either side. For each fillet 31, curved surface 222 is sandwiched by upper straight surface 215 that also forms a part of tang 28, and lower straight surface 217 that also forms a part of tang 29. For each fillet 32, curved surface 223 is sandwiched by upper straight surface 218 that also forms a part of tang 29 and lower straight surface 220 that also forms a part of tang 30.

Each one of fillets 33 comprises an inwardly curved surface 224 connected on each end to another inwardly curved surface. At its upper end, surface 224 connects to curved surface 228 that transitions it into straight surface 221 that also forms a part of tang 30. At its lower end, surface 224 connects to curved surface 225 with these surfaces 225 of each fillet 33 being joined at the centerline C.

Figure 3A:
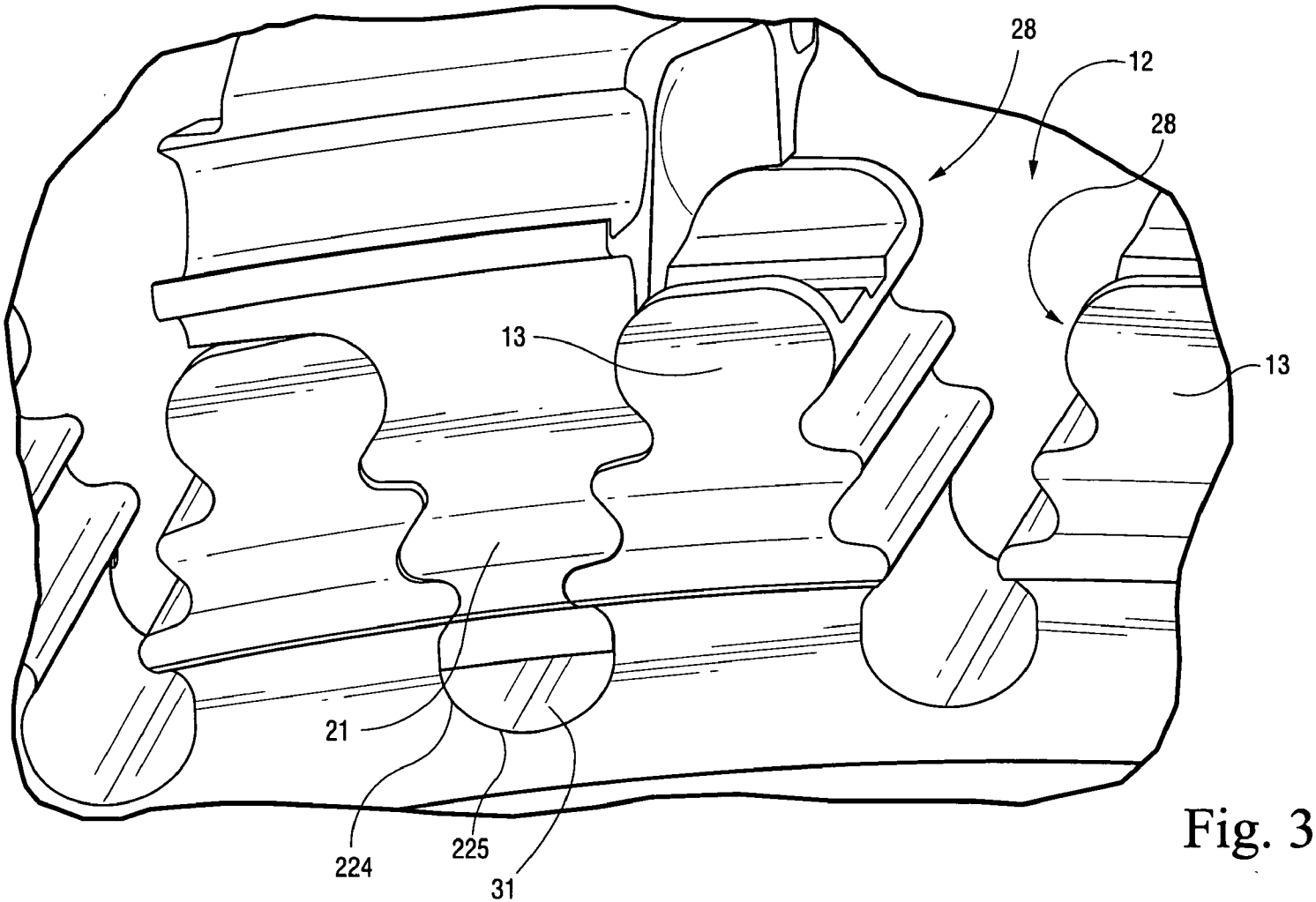
FIG. 3A shows a forward view a bucket interlocked between corresponding wheelposts.
Figure 3B:
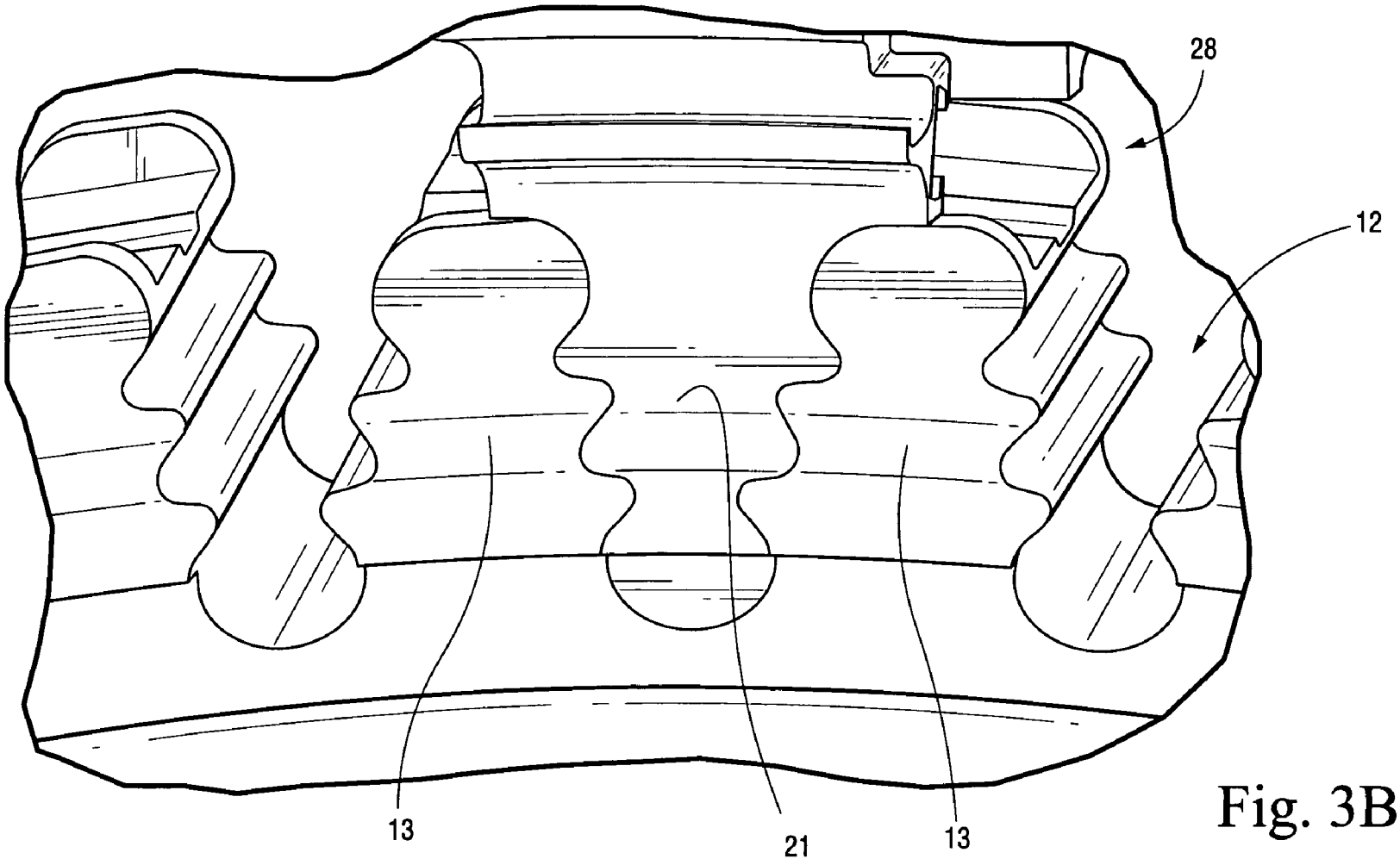
FIG. 3B shows an aft view of a bucket interlocked between corresponding wheelposts.
Figure 4:
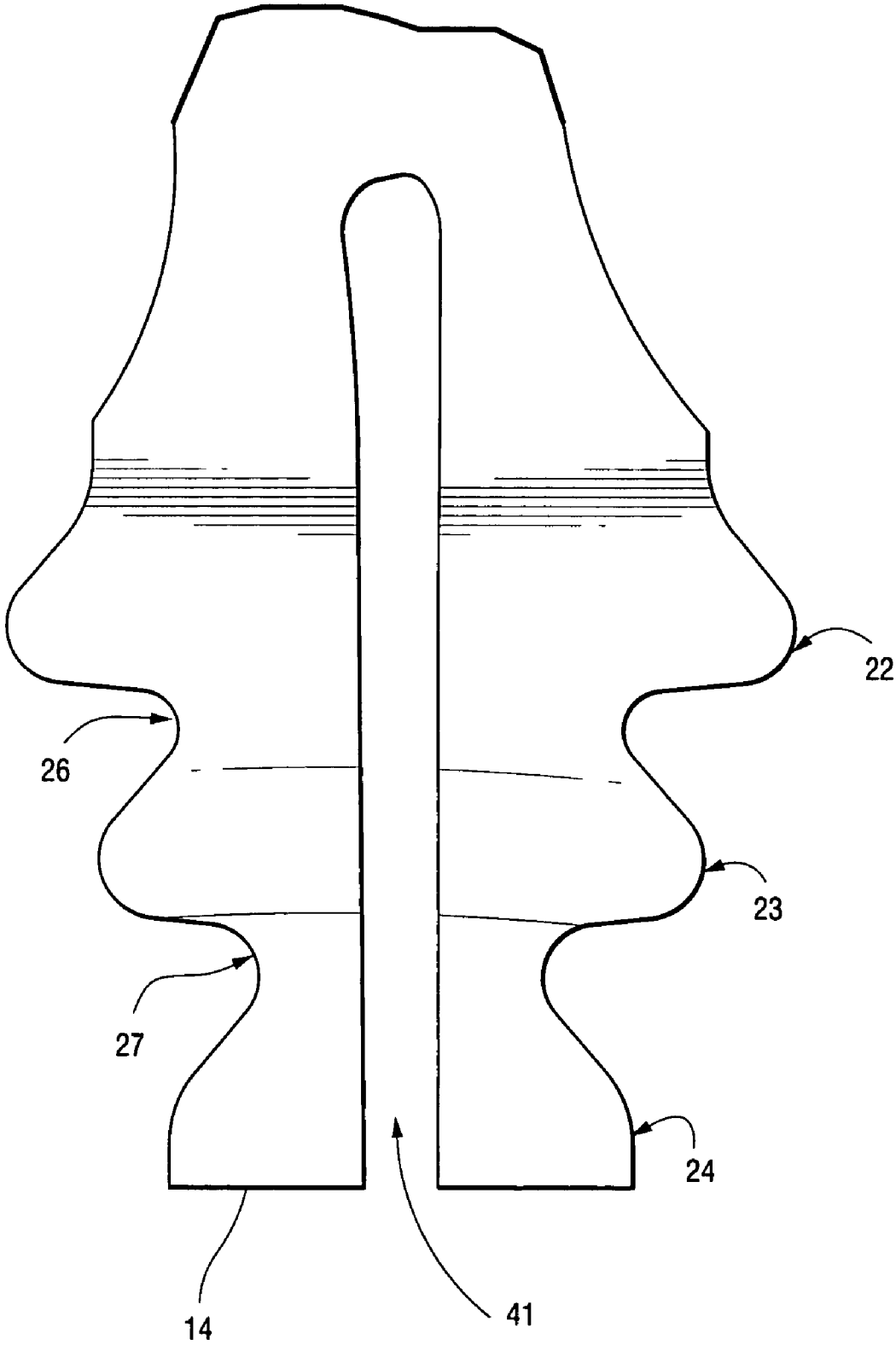
FIG. 4 represents an interior cross-sectional schematic drawing of the attachment portion of a bucket.
Figure 5:
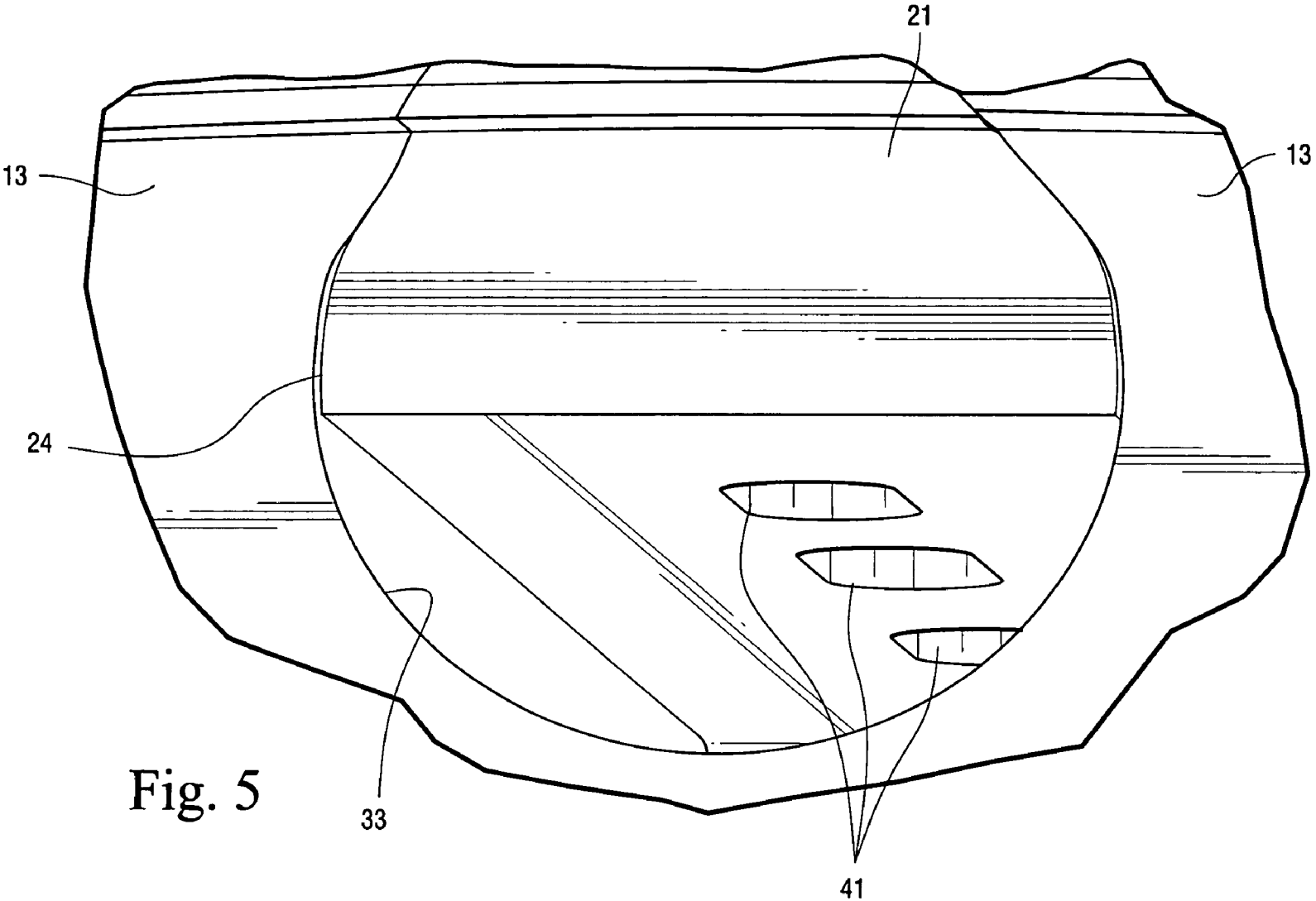
FIG. 5 shows the slot opening area beneath the bucket for cooling air delivery.

FIGS. 3A and 3B show forward and aft views of bucket root 21 interlocked within wheelposts 13 (or installed in broach slot 12). In FIGS. 3A and 3B, empty broach slot 12 is adjacent to the slot with the bucket root 21 installed and shows in perspective upper tang 28 of wheelpost 13. A horizontal (axial) air channel 31 is formed between surfaces 224 and 225 of the broach slot and the bottom flat surface of the bucket root and communicates with vertical (radial) air passages 41, shown in FIGS. 4 and 5. Air channel 31 allows an adequate amount of cooling air to the bucket, while maintaining an adequate live rim radius to reduce the amount of dead weight in the firtree and wheelpost. More particularly, as shown in FIG. 4, the neck above the bottom tang on the firtree (between fillets 27) has been sized to permit passage of sufficient airfoil cooling air while maintaining an adequate thickness to carry the necessary loading at reasonable stress levels.

Figure 6:
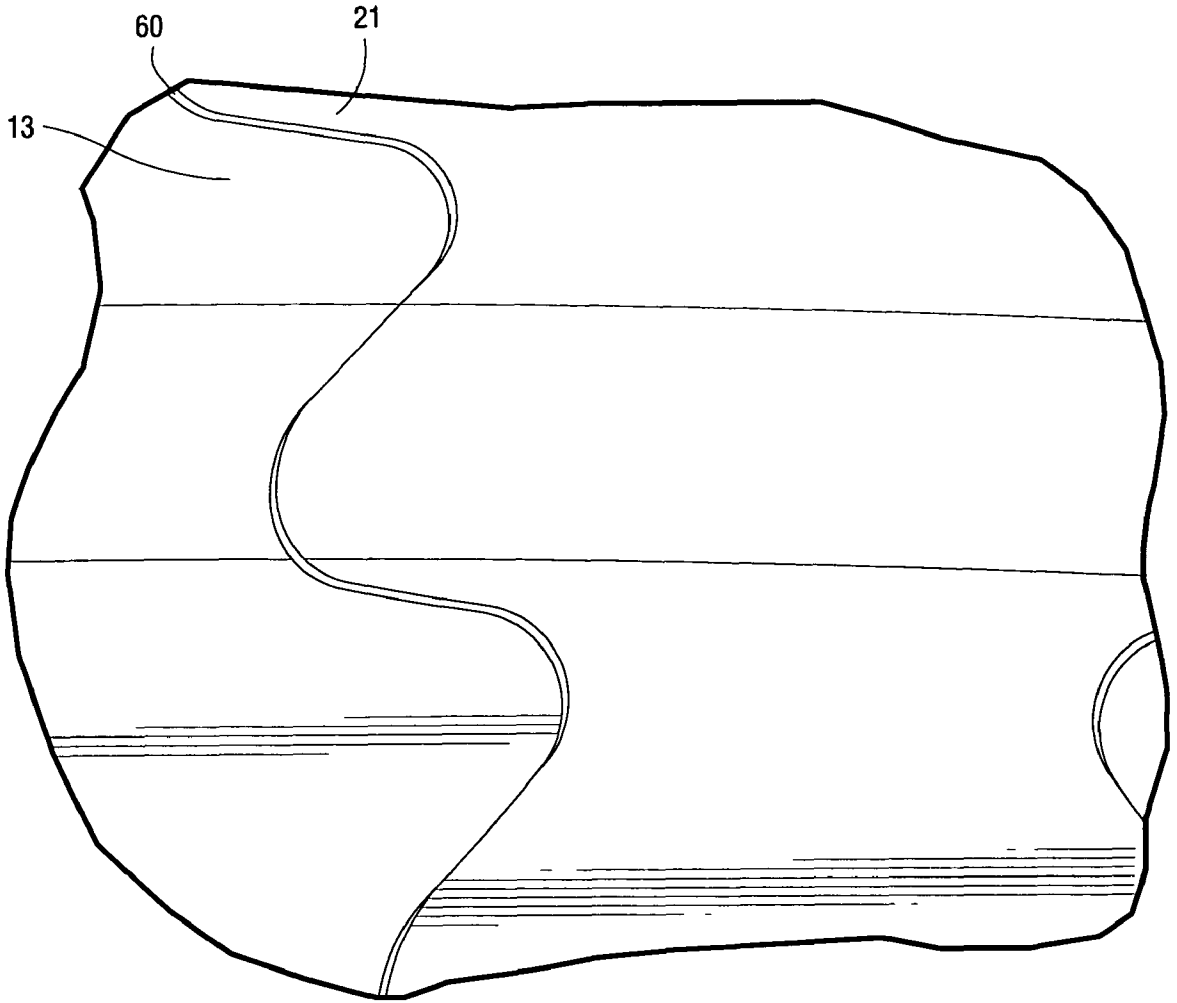
FIG. 6 shows gaps between an installed bucket and an adjacent wheelpost in the operating (loaded outward) condition.

As shown in FIG. 6, a small gap 60 exists between a bucket root 21 and wheelpost 13 in wheel 10, when the bucket root is inserted into the broach slot 12. This gap or clearance is provided to facilitate the insertion of the buckets into the broach slots and to accommodate manufacturing tolerances.

Figure 7:
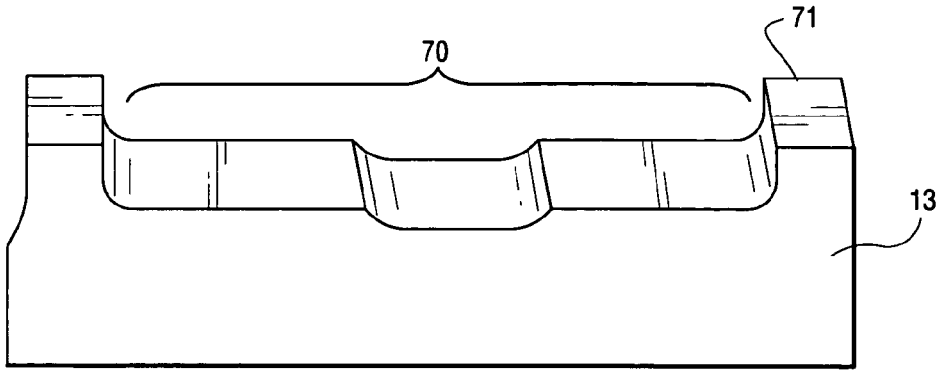
FIG. 7 shows a perspective view of the upper edge of a wheelpost.
Figure 8:
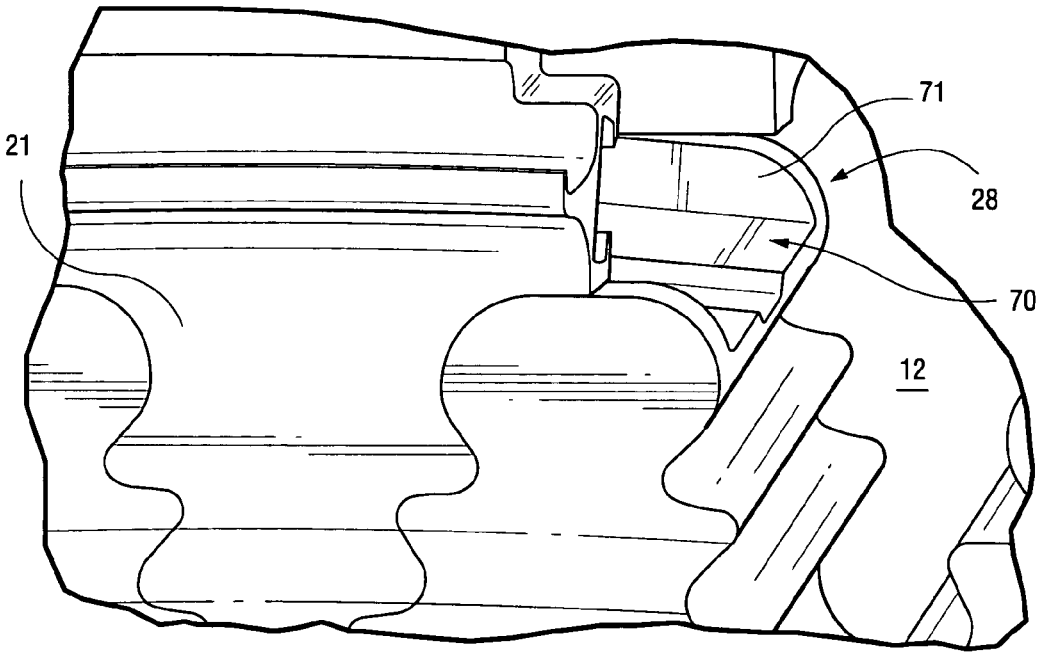
FIG. 8 shows a perspective view of the upper edge of a wheelpost with an installed bucket.

As shown in FIGS. 7 and 8, center region 70 of upper tangs 28 of wheelpost 13, looking at a tangential cross-section, has been scalloped away to reduce weight, which reduces rotor pull and stresses in wheelpost 13. The lobes 71 on the end remain to seal against the bucket to reduce leakage across the firtree/shank region.

The bucket root 21, as described above, incorporates a uniquely sized and interleaved triple fillet and tang arrangement so as to distribute concentrated stresses evenly over a larger region, thus lowering peak stresses and improving LCF capability. The arrangement allows for a significant reduction from 92 buckets and wheelposts to 60 buckets and wheelposts for the first two stages of a turbine.

The radial thickness of bottom tang 24 as set by surface 14 in FIG. 4 has been uniquely sized such that an equalized distribution of loading exists among the tangs. This stiffness adjustment results in even stress distributions throughout the firtree and wheelpost thus improving the LCF capability of the parts as well as reducing peak crush stresses on the bearing faces.

The fillets, between the tangs on the bucket firtree, and on the wheelpost have been sized to reduce occurrence of peak stresses thus improving LCF capability.

The fillet above the top tang on the bucket firtree incorporates a compound fillet so as to distribute the concentrated stresses over a larger region, thus lowering peak stresses and improving LCF capability. The top of the wheelpost, as the form transitions away from the contact face and into the top sealing lobe, incorporates an elliptical curve to make this transition. Likewise, the bottom of the bucket firtree, as the form transitions away from the contact face and into the bottom-sealing lobe, incorporates an elliptical curve to make this transition.

Figure 10:
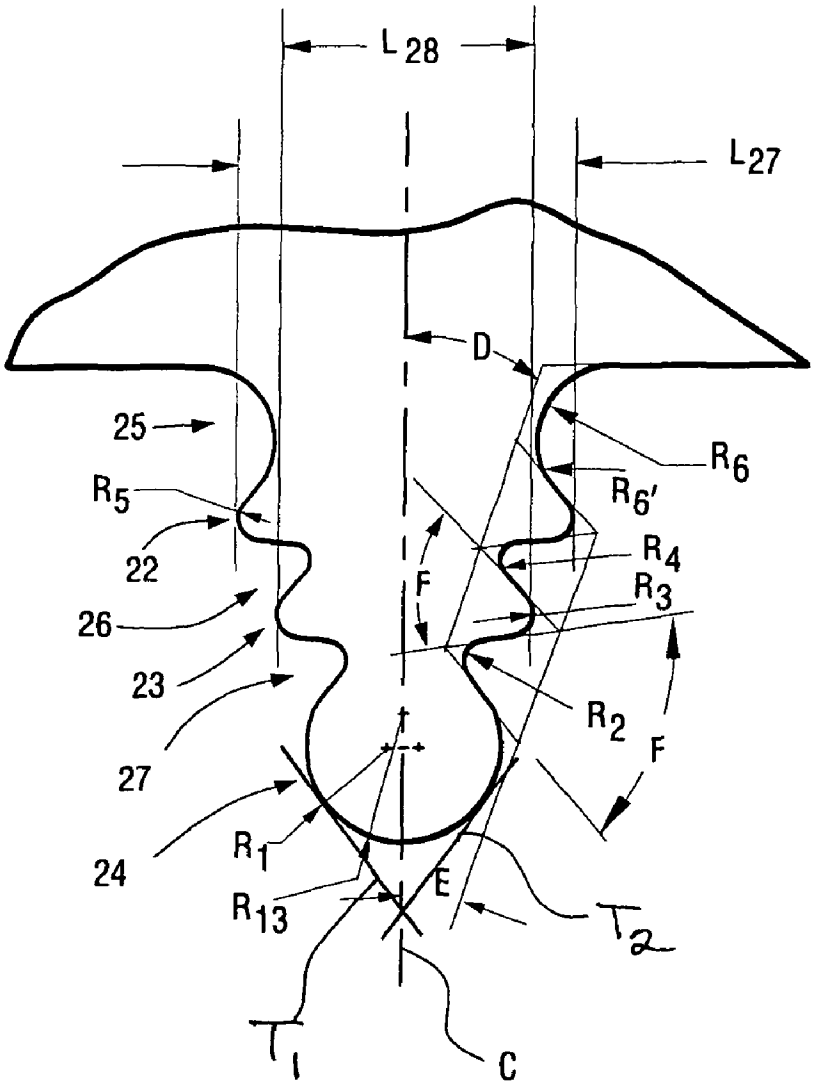
Figure 12:
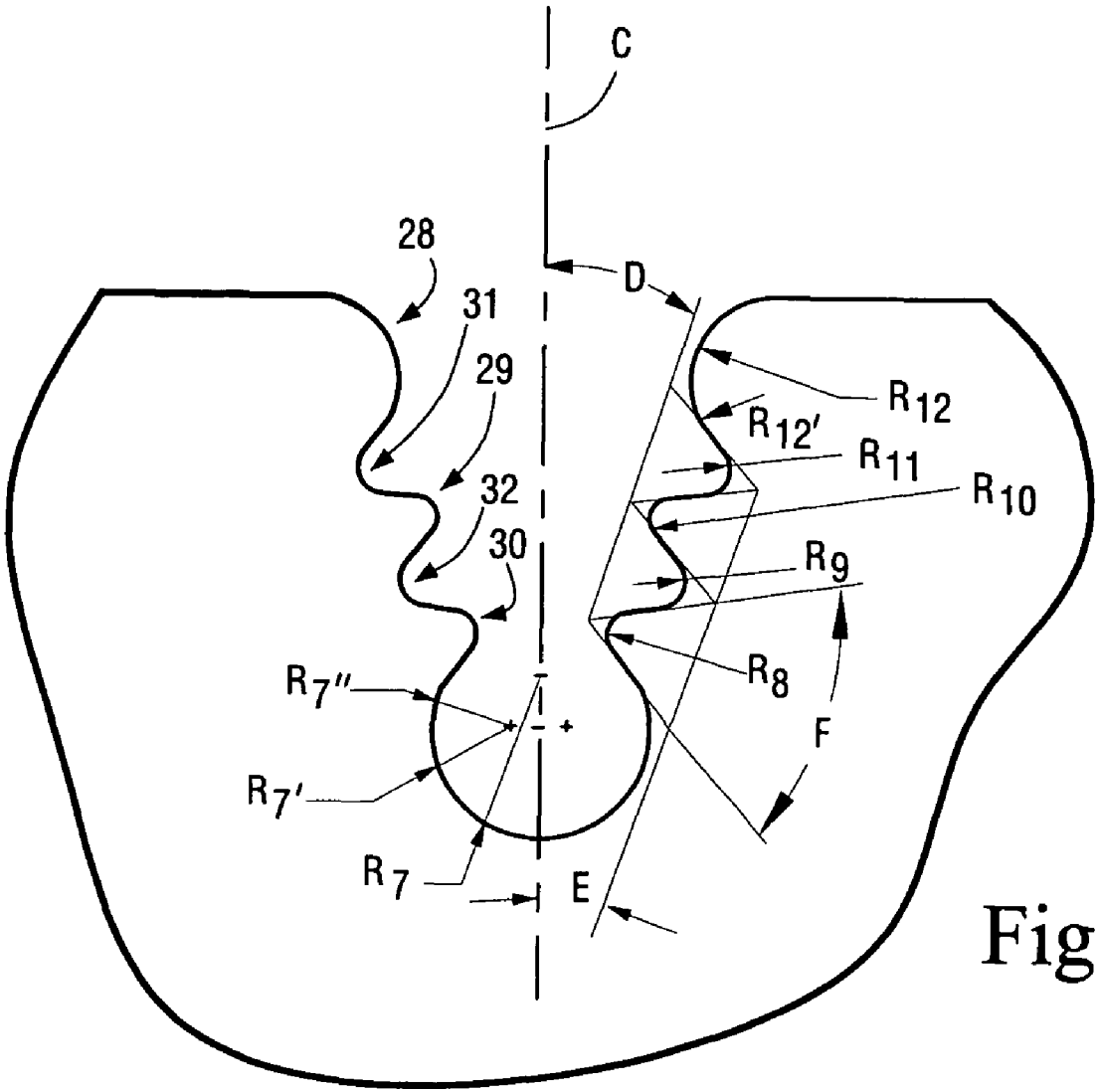

The divergence angles D of the contact faces (angle to centerline of dovetail), shown in FIGS. 10 and 12, are set at 21.000° so that the appropriate balance between the crush stresses on the contact faces and the peak stresses in the adjacent fillets is achieved. The divergence angles E also shown in FIGS. 10 and 12, of the array of tangs on each side of the form, have been set at 20.782° so that the appropriate balance among various limits (p/a stress, crush stress, peak stresses, etc.) has been maintained.

Figure 9:
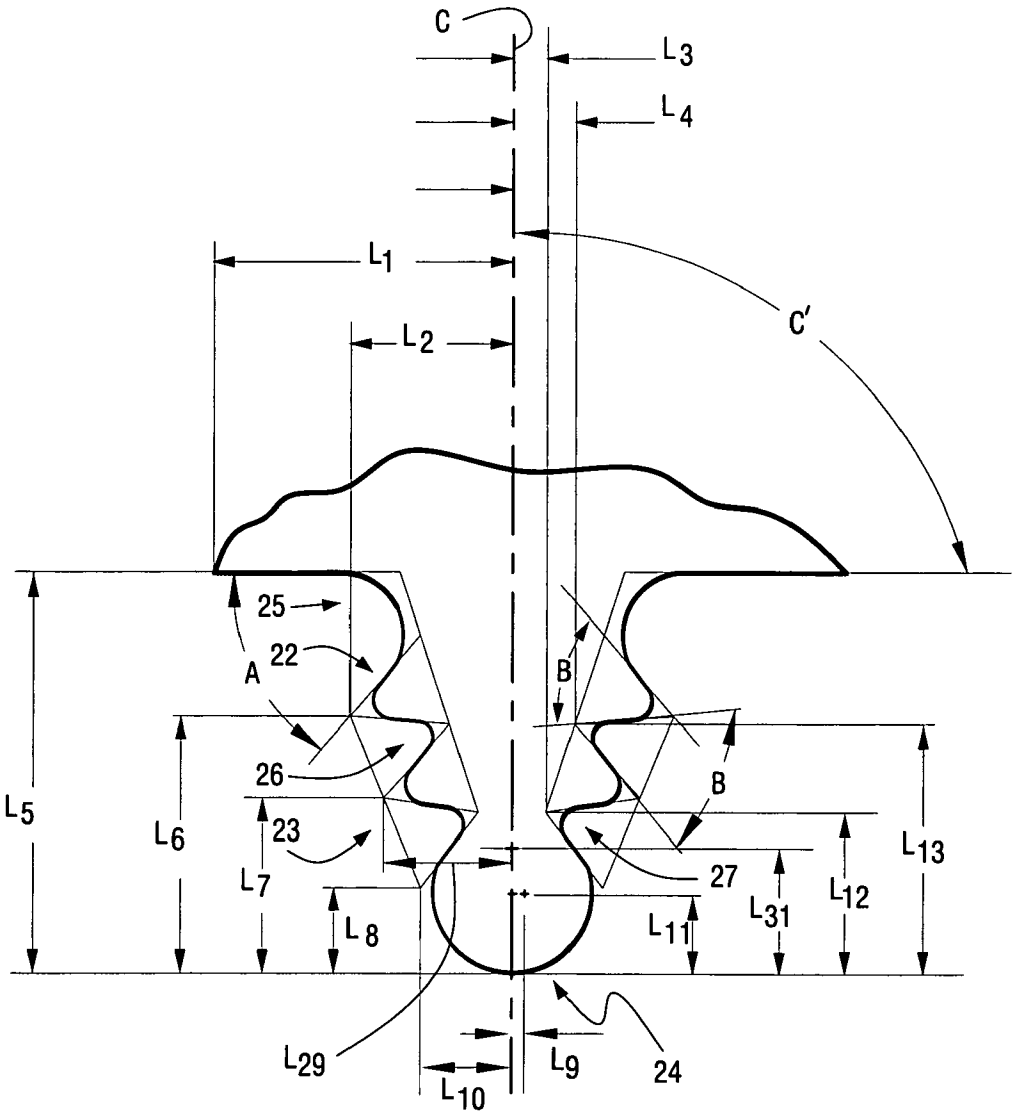
FIGS. 9 and 10 show dimensional aspects of a bucket.
Figure 11:
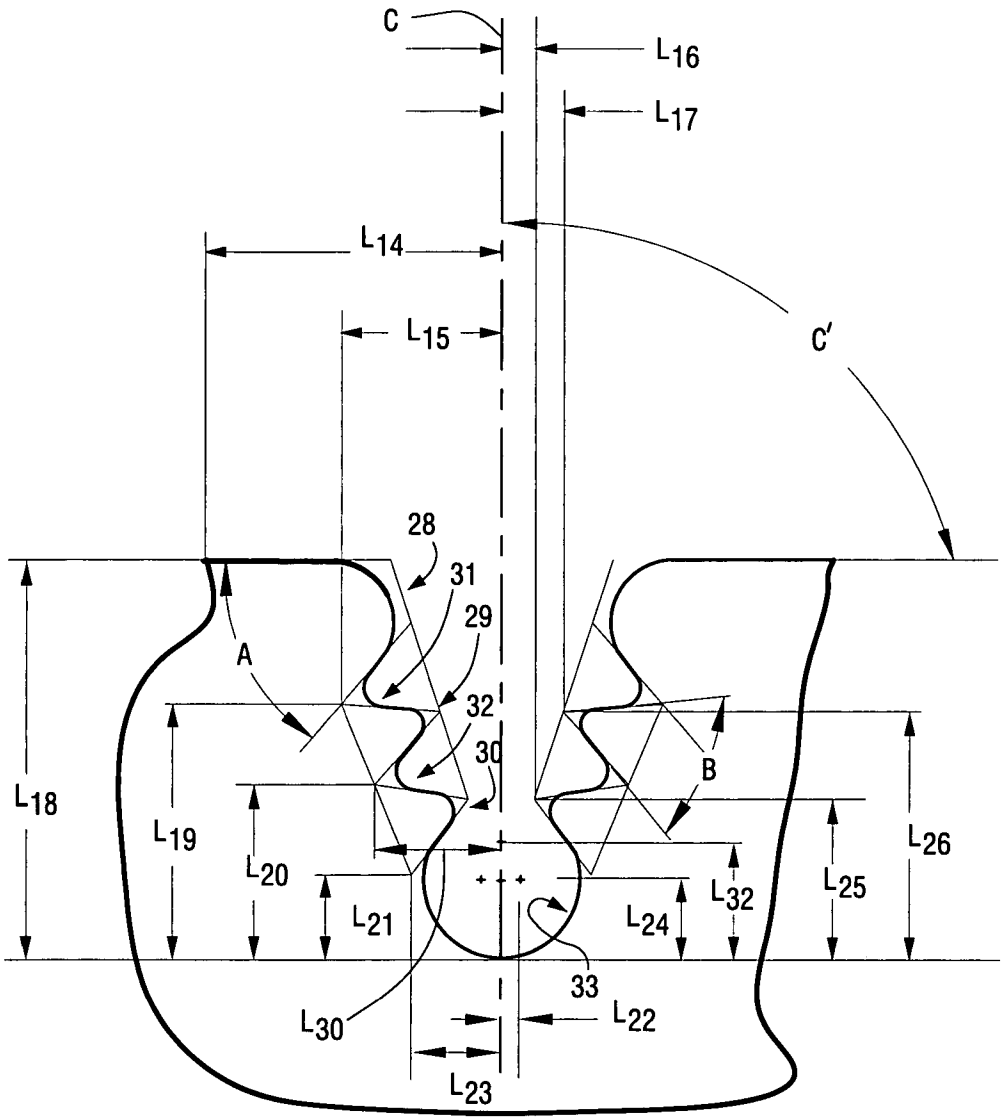
FIGS. 11 and 12 show dimensional aspects of the corresponding broach slot in which the bucket of FIGS. 9 and 10 installs.

FIGS. 9 and 10 provide exemplary and preferred dimensions of the bucket and FIGS. 11 and 12 provide exemplary and preferred dimensions for the broach slot into which the bucket of FIGS. 9 and 10 is inserted. In all cases, the preferred relative dimensions with respect to the buckets and wheelposts shown in FIGS. 9-12 are such that the line and curve segments fall within offsets of the defined profile at ±0.001 inches. Of course, those skilled in the art will recognize that minor changes beyond those tolerance ranges will not impact, to any substantial effect, the practice of the invention, and therefore should be considered to be within the scope of the invention. For example, a set of joined lines and curves falling within a tolerance zone defined by profile offsets of ±0.01 inches may still meet the intent of the invention. Further, the sides of the bucket dovetail or broach, mirrored by the centerline, may be separated differently and still fall within this scope. For example, dimensions L1, L2, L3, L4, L9 and L10 in FIG. 9 could be increased or decreased by a constant amount to change the overall width of the bucket dovetail.

As shown in FIG. 9, the angle A that depicts the angular orientation of tang pressure faces 202, 205 and 208 relative to horizontal equals 50.000°. The angles B of the first tang 22 and the second fillet 26 equal 56.087°. The angles F of the second tang 23 and lowermost fillet 27, shown in FIG. 10, equal 56.964°. In all of the angular measurements described in this application, the angle to be measured is defined by tangent lines along the outer boundaries of the portions of the bucket or wheelpost to be measured or between the center line of the bucket or wheelpost and a line defined by the intersection points resulting from at least two sets of the aforementioned intersecting tangent lines.

FIG. 9 also shows that the termination of upper fillet 25 forms a 90.000° angle with the center line C through the bucket as denoted by angle C'. In FIG. 10 angles D and E are measured from center line C to lines defined by points at which tangent lines along the first and second fillets and tangs, respectively, intersect. Angles D and E are respectively 21.000° and 20.782° . As shown in FIG. 10, intersecting tangent lines $T_1$ and $T_2$ along the pressure faces of the bottommost tang do not lie on either line that forms the angle E of 20.782° with the center line.

FIG. 9 shows a number of dimensional relationships $L_1$ through $L_{13}$, $L_{29}$ and $L_{31}$ which define the relative position of the tangs and fillets that form the geometric configuration of the bucket.

$L_1$ measures 1.6300 inches and $L_2$ measures 0.7846 inches, with $L_1$ representing the outermost distance or width of the bucket from center line C and $L_2$ representing the distance from the center line C to the intersection point of the tangent lines formed along either side of tang 22. $L_{29}$ measures 0.6268 inches and defines the distance from center line C to the intersection point of tangent lines drawn along either side of tang 23. $L_{11}$ measures 0.4654 inches and depicts the distance from the center line C to the intersection point of a line drawn through intersection points defined above with respect to tangs 22 and 23 and a tangent line along upper straight surface 208 of tang 24.

$L_5$ to $L_8$ define the distances from the bottom surface of tang 24 to, respectively, the uppermost straight portion of fillet 25, the intersection point of tangent lines drawn along tang 22, the intersection point of tangent lines drawn along tang 23, and the intersection point of a line drawn through the intersection points defined above with respect to tangs 22 and 23 and a tangent line along upper straight surface 208 of tang 24. These distances $L_5$ through $L_8$ are, respectively, 1.9836 inches, 1.2588 inches, 0.8429 inches, and 0.4177 inches.

Distance measures $L_{11}$, $L_{31}$ depict the distance from the bottom of tang 24 to the points from which the radii of curvatures for the curved portions of tang 24 are defined. $L_{12}$ and $L_{13}$ depict the distance from the bottom of tang 24 to, respectively, the intersection point of tangent lines drawn along fillet 27, and the intersection point of tangent lines drawn along fillet 26. $L_{11}$, $L_{31}$, $L_{12}$, and $L_{13}$ measure, respectively, 0.3792 inches, 0.5556 inches, 0.7855 inches and 1.2092 inches.

Dimensions $L_3$ and $L_4$, respectively, give the distance from center line C to the intersection point of tangent lines along fillet 27 and the intersection point of tangent lines drawn along fillet 26. $L_3$ and $L_4$ measure, respectively, 0.1568 inches and 0.3194 inches.

As noted above, tang 24 is formed in part by two radial curves having center points offset from either side of center line C. A third radial curve forming tang 24 has its center point on center line C the distance $L_{31}$ from the bottom of tang 24. Distance $L_9$ shows the offsets to the right and left of center line C (offset is only shown to the right of center line C in FIG. 9) and measures 0.0327 inches. The offset radii are shown in FIG. 10 as $R_1$ and measure 0.3762 inches. The radius for the curve having its center point on the center line is shown in FIG. 10 as $R_{13}$ and measures 0.5556 inches.

$L_{27}$ denotes the width of the uppermost tangs 22 which measures 1.3850 inches, and $L_{28}$ denotes the width of the intermediate tangs 23 which measures 1.0543 inches.

In addition to radii $R_1$ and $R_{13}$, FIG. 10 also shows radii $R_2$ through $R_6$ which respectively represent the radius of the lowermost fillet 27, the radius of the intermediate tang 23, the radius of fillet 26, the radius of the uppermost tang 22 and the radii of the uppermost fillet 25. These radii $R_2$ through $R_6$ are respectively, 0.0897 inches, 0.1037 inches, 0.0741 inches, 0.0959 inches, 0.0983 inches ($R_{6'}$) and 0.3342 inches ($R_6$).

Curve 227 joins tang 24 with fillet 27 and is an elliptical radius with semi-major axis 0.0356 inches and semi-minor axis 0.0036 inches.

As noted above, FIGS. 11 and 12 show the dimensions related to the corresponding broach slots. In FIGS. 11 and 12 the angles A, B, C' and D through F are identical in measurement to the complementary angles A, B, C' and D through F in FIGS. 9 and 10.

FIG. 11 shows a number of dimensional relationships $L_{14}$ through $L_{26}$, $L_{30}$ and $L_{32}$ that define the relative position of the tangs and fillets that form the geometric configuration of the broach slot.

$L_{14}$ measures 1.4000 inches and $L_{15}$ measures 0.7893 inches, with $L_{14}$ representing the outermost distance or width of the wheelpost from center line C and $L_{15}$ representing the distance from the center line C to the intersection point of the tangent lines formed along either side of fillet 31. $L_{30}$ measures 0.6315 inches and defines the distance from center line C to the intersection point of tangent lines drawn along either side of tang fillet 32. $L_{23}$ measures 0.4701 inches and depicts the distance from the center line C to the intersection point of a line drawn through the intersection points defined above with respect to fillets 31 and 32 and a tangent line along upper straight surface 221 of fillet 33.

$L_{18}$ to $L_{21}$ define the distances from the bottom of fillet 33 to, respectively, the uppermost straight portion of tang 28, the intersection point of tangent lines drawn along fillet 31, the intersection point of tangent lines drawn along fillet 32, and the intersection point of a line drawn through the intersection points defined above with respect to fillets 31 and 32 and a tangent line along the upper straight surface 221 of fillet 33. These distances $L_{18}$ through $L_{21}$ are, respectively, 1.9836 inches, 1.2592 inches, 0.8433 inches, and 0.4181 inches.

Distance measures $L_{24}$, $L_{32}$ depict the distance from the bottom of fillet 33 to the points from which the radii of curvature for the curved portions of fillet 33 are defined. $L_{25}$ and $L_{26}$ depict the distance from the bottom of fillet 33 to, respectively, the intersection point of tangent lines drawn along tang 30, and the intersection point of tangent lines drawn along tang 29. $L_{24}$, $L_{32}$, $L_{25}$, and $L_{26}$ measure, respectively, 0.3852 inches, 0.5616 inches, 0.7859 inches and 1.2096 inches.

Dimensions $L_{16}$ and $L_{17}$, respectively, give the distance from center line C to the intersection point of tangent lines along tang 30 and the intersection point of tangent lines drawn along tang 29. $L_{16}$ and $L_{17}$ measure, respectively, 0.1615 inches and 0.3241 inches.

Fillet 33 is formed by two radial curves having center points offset from either side of center line C and a third radial curve with its center point on center line C the distance $L_{32}$ from the bottom of fillet 33. The offset radii are shown in FIG. 12 as $R_{7'}$ measuring 0.3822 inches and $R_{7''}$ measuring 0.1248 inches. Distance $L_{22}$ shows the offsets to the right and left of center line C for the offset radial curves $R_{7'}$(the offset is only shown to the right of center line C in FIG. 11) and measures 0.0327 inches. The radius for the curve having its center point on the center line is shown in FIG. 12 as $R_7$ and measures 0.5616 inches.

In addition to radii $R_7$ through $R_{7''}$, FIG. 12 also shows radii $R_8$ through $R_{12}$ which respectively represent the radius of tang 30, the radius of fillet 32, the radius of tang 29, the radius of the uppermost fillet 31 and the radius of the uppermost tang 28. These radii $R_8$ through $R_{12}$ are respectively, 0.0897 inches, 0.1037 inches, 0.0741 inches, 0.0959 inches, and 0.3282 inches.

Curve 215 joins tang 28 with filet 31 and is an elliptical radius with semi-major axis 0.0356 inches and semi-minor axis 0.0028 inches.

Figure 13:
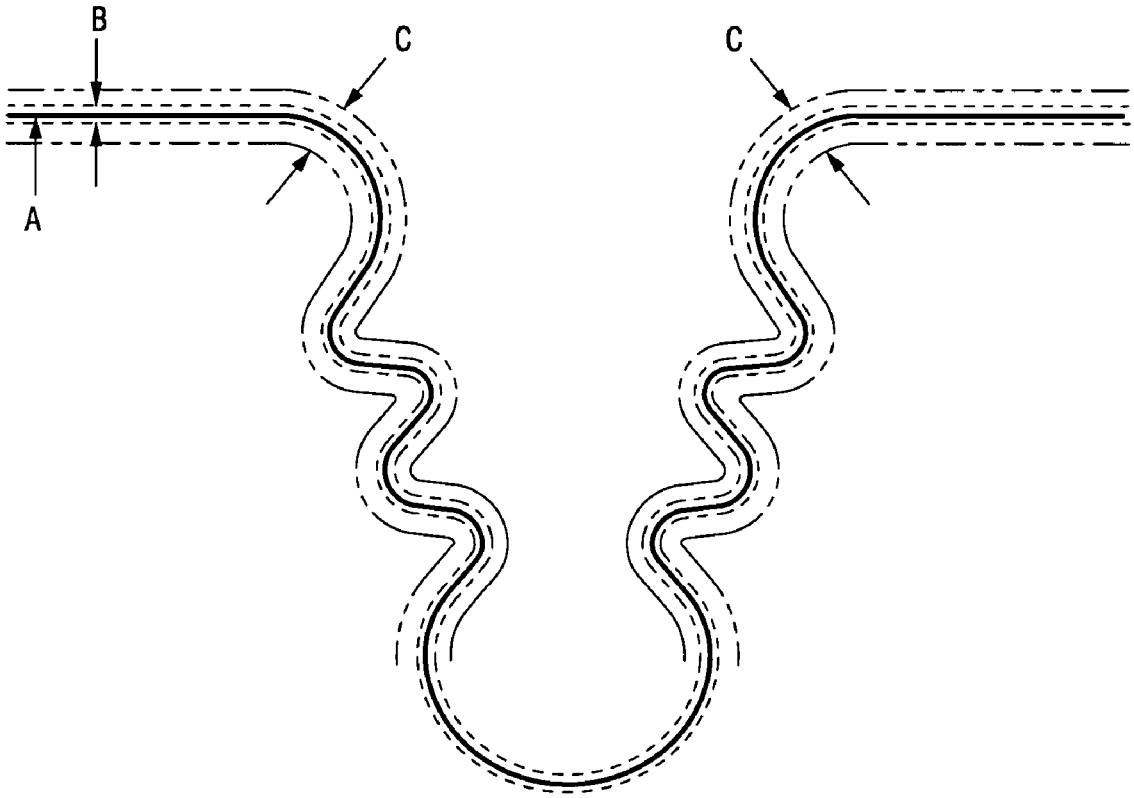
FIG. 13 schematically shows zones for slight dimensional changes from those of the preferred embodiment.

FIG. 13 schematically depicts that the bucket dovetail and wheel broach profiles can be formed within a range of tolerances as shown by the heavy and dotted lines. For example, with respect to the bucket, its outer dimensions could be altered from the solid line to a shape within the dotted lines.

In FIG. 13, 'A' represents the combination of lines and curves making up the bucket dovetail or wheel broach profile as defined exactly. 'B' represents the zone bound by offsets of 'A' by ±0.001 inches and contains profile variations that meet the preferred embodiment. 'C' represents the zone bound by offsets of the individual mirrored sides of 'A' by ±0.01 inches and contains profile variations that fall within the scope of the invention.

In particular, all of the dimensions for the bucket and wheel could be scaled larger or smaller than those given for the preferred embodiment. Furthermore, the two sides of the bucket (and corresponding broach slot) could be spaced differently by increasing or decreasing dimensions $L_1$, $L_2$, $L_3$, $L_4$, $L_9$, $L_{10}$ which would result in different bottom fillet radii 227, 211 and 212 for the bucket. Similarly, increasing or decreasing the corresponding dimensions of the broach slot would result in different bottom fillet radii 228, 224 and 225.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine having multiple turbine stages, first and second turbine stages comprising:

a wheel having sixty broach slots, each one of said broach slots having an interleaved system of fillets and tangs; and a plurality of buckets each having a corresponding interleaved system of fillets and tangs so that said plurality of buckets can be fitted, one to one, into said sixty broach slots on said wheel;

wherein said interleaved system of fillets and tangs on said buckets and broach slots act to reduce stresses acting on said fitted buckets and broach slots, the fillets and tangs of said interleaved system of fillets and tangs each being formed by a combination of curved and straight surfaces;

wherein for each one of said plurality of buckets the distance from the bottom of the bottom most tang to the upper most straight portion of the upper most fillet is 1.9836 inches;

wherein for each one of said plurality of buckets the distance from the bottom of the bottom most tang to a first intersection point of tangent lines drawn along pressure faces of the tang adjacent to the bottom most tang is 0.8429 inches;

wherein for each one of said plurality of buckets the distance from the bottom of the bottom most tang to a second intersection point of tangent lines drawn along pressure faces of the upper most tang is 1.2588 inches.

2. The turbine as claimed in claim 1, wherein for each one of said plurality of buckets the distance from the bottom of the bottom most tang to a point defined by the intersection of a line through said first and second intersection points and a tangent line along an upper straight surface of the bottom most tang is 0.4177 inches.

3. The turbine as claimed in claim 1, wherein for each one of said plurality of buckets the angle between the upper most straight portion of the upper most fillet and the upper most straight portion of the upper most tang is 50 degrees.

4. The turbine as claimed in claim 2, wherein for each one of said plurality of buckets the angle between the upper most straight portion of the upper most fillet and the upper most straight portion of the upper most tang is 50 degrees.

5. A turbine having multiple turbine stages, first and second turbine stages comprising:

a wheel having sixty broach slots, each one of said broach slots having an interleaved system of fillets and tangs; and a plurality of buckets each having a corresponding interleaved system of fillets and tangs so that said plurality of buckets can be fitted, one to one, into said sixty broach slots on said wheel;

wherein said interleaved system of fillets and tangs on said buckets and broach slots act to reduce stresses acting on said fitted buckets and broach slots, the fillets and tangs of said interleaved system of fillets and tangs each being formed by a combination of curved and straight surfaces;

wherein below the uppermost tang on each of said broach slots there is a fillet having a radius of curvature of 0.0959 inches;

wherein above the bottom most tang on each of said broach slots there is a fillet having a radius of curvature of 0.1037 inches;

wherein below the bottom most tang on each of said broach slots there is a compound fillet having a first radius of curvature of 0.1248 inches and a second radius of curvature of 0.3822 inches, the first radius of curvature being measured from two points equally offset 0.0327 inches from either side of a center line bisecting each of said broach slots and at a distance of 0.3852 inches from the bottom of said compound fillet, and the second radius of curvature being measured from the center line bisecting each of said broach slots at a distance of 0.5616 inches from the bottom of said compound fillet.

6. A turbine having multiple turbine stages, first and second turbine stages comprising:

a wheel having sixty broach slots, each one of said broach slots having an interleaved system of fillets and tangs; and a plurality of buckets each having a corresponding interleaved system of fillets and tangs so that said plurality of buckets can be fitted, one to one, into said sixty broach slots on said wheel;

wherein said interleaved system of fillets and tangs on said buckets and broach slots act to reduce stresses acting on said fitted buckets and broach slots, the fillets and tangs of said interleaved system of fillets and tangs each being formed by a combination of curved and straight surfaces;

wherein for each one of said broach slots the distance from the bottom of the bottom most fillet to the upper most straight portion of the upper most tang is 1.9836 inches;

wherein for each one of said broach slots the distance from the bottom of the bottom most fillet to a first intersection point of tangent lines drawn along pressure faces of the fillet adjacent to the bottom most fillet is 0.8433 inches;

wherein for each one of said broach slots the distance from the bottom of the bottom most fillet to a second intersection point of tangent lines drawn along pressure faces of the upper most fillet is 1.2592 inches.

7. The turbine as claimed in claim 6, wherein for each one of said broach slots the distance from the bottom of the bottom most fillet to a point defined by the intersection of a line through said first and second intersection points and a tangent line along an upper straight surface of the bottom most fillet is 0.4181 inches.

8. The turbine as claimed in claim 6, wherein for each one of said broach slots the angle between the upper most straight portion of the upper most tang and the upper most straight portion of the upper most fillet is 50 degrees.

9. The turbine as claimed in claim 7, wherein for each one of said broach slots the angle between the upper most straight portion of the upper most tang and the upper most straight portion of the upper most fillet is 50 degrees.

* * * * *

UNITED STATES PATENT AND TRADEMARK OFFICE

CERTIFICATE OF CORRECTION

PATENT NO. : 7,905,709 B2
APPLICATION NO. : 10/774400
DATED : March 15, 2011
INVENTOR(S) : Lagrange et al.

It is certified that error appears in the above-identified patent and that said Letters Patent is hereby corrected as shown below:

At column 6, line 17, delete "$L_{11}$ measures" and insert --$L_{10}$ measures--

Signed and Sealed this
Seventeenth Day of May, 2011

David J. Kappos

David J. Kappos
*Director of the United States Patent and Trademark Office*